US010881206B2

(12) United States Patent
Cattaneo

(10) Patent No.: US 10,881,206 B2
(45) Date of Patent: Jan. 5, 2021

(54) CONCEALED HANGING-BRACKET GROUP WITH ANTI-DISENGAGEMENT HAVING EASY ACCESS TO ADJUSTMENTS

(71) Applicant: Leonardo S.r.l., Figino Serenza (IT)

(72) Inventor: Carlo Cattaneo, Figino Serenza (IT)

(73) Assignee: Leonardo S.r.l., Figino Serenza (IT)

( * ) Notice: Subject to any disclaimer, the term of this patent is extended or adjusted under 35 U.S.C. 154(b) by 0 days.

(21) Appl. No.: 16/336,104

(22) PCT Filed: Oct. 4, 2017

(86) PCT No.: PCT/EP2017/075151
§ 371 (c)(1),
(2) Date: Mar. 24, 2019

(87) PCT Pub. No.: WO2018/069099
PCT Pub. Date: Apr. 19, 2018

(65) Prior Publication Data

US 2019/0231072 A1 Aug. 1, 2019

(30) Foreign Application Priority Data

Oct. 14, 2016 (IT) ..... 102016000103544

(51) Int. Cl.
*A47B 95/00* (2006.01)

(52) U.S. Cl.
CPC ..... *A47B 95/008* (2013.01)

(58) Field of Classification Search
CPC combination set(s) only.
See application file for complete search history.

(56) References Cited

U.S. PATENT DOCUMENTS 5,090,652 A * 2/1992 Cattaneo ..... A47B 95/008 24/590.1
10,010,176 B2 * 7/2018 Cattaneo ..... A47B 95/008
(Continued)

FOREIGN PATENT DOCUMENTS

| | | |
|---|---|---|
| DE | 20314821 | 12/2003 |
| DE | 202015103519 | 10/2016 |
| WO | WO 2018/069099 | 4/2018 |

OTHER PUBLICATIONS

International Search Report and the Written Opinion dated Nov. 24, 2017 From the International Searching Authority Re. Application No. PCT/EP2017/075151. (9 Pages).

*Primary Examiner* — Monica E Millner

(57) ABSTRACT

A concealed hanging-bracket group (10) with anti-disengagement having easy access to adjustments for the wall assembly of a wall cupboard (M) comprising a plate element (11), provided with a plurality of fixing pins (12,12',12") that can be coupled in holes produced on a shoulder (S) of the wall cupboard (M) which extend from at least one side of the plate element (11), and a hooking element (14) of the hanging bracket with a supporting element (50) fixed to the wall, adjustably coupled in the front with the plate element (11) in depth (K) and in height (H) and provided with an upper hook-shaped portion (15), means (16,17) for horizontally and vertically moving the hooking element (14) with respect to the plate element (11) and anti-disengagement means (18) of the hanging bracket also being provided, wherein an element (24,57) is provided in the plate element (11) having a threaded hole (25,58) for an adjustment grub screw (26) in depth, a guide (47) for a screwdriver and a stop (48) for a tip of the screwdriver (42) also being provided in the element (24,57).

17 Claims, 7 Drawing Sheets

(56) References Cited

U.S. PATENT DOCUMENTS 10,092,101 B2 * 10/2018 Cattaneo ..... A47B 95/008
10,512,329 B2 * 12/2019 Cattaneo ..... A47B 95/008

* cited by examiner 10
15
52
14
26
27
47'
28
39
30
33
22
58
12
20'
20
11
60
59
47
48
37
32
36
38

20
11
52
49
55
26
41
58
37
36
20'
20'
20
10
12
12'
57
12"
19
22

20
11
12
52
12'
12"
36
19
20'
20'
20
10
15
14
27
28
37
31
30
33
22

10
52
15
14
26
27
67'
28
39
30
33
22
58'
12
20'
69
20
11
67
68
37
32
36
38

20
11
52
49
57'
26
41
58'
37
36
20'
20'
20
10
12
12'
12"
19
22

20
11
12
52
12'
12"
36
19
20'
20'
20
10
49
15
14
27
28
37
31
30
33
22

CONCEALED HANGING-BRACKET GROUP WITH ANTI-DISENGAGEMENT HAVING EASY ACCESS TO ADJUSTMENTS

RELATED APPLICATIONS

This application is a National Phase of PCT Patent Application No. PCT/EP2017/075151 having International filing date of Oct. 4, 2017, which claims the benefit of priority of Italian Patent Application No. 102016000103544 filed on Oct. 14, 2016. The contents of the above applications are all incorporated by reference as if fully set forth herein in their entirety.

FIELD AND BACKGROUND OF THE INVENTION

The present invention relates to a concealed hanging-bracket group with anti-disengagement having easy access to adjustments.

The technical field is that relating to concealed hanging brackets, suitable for being mounted in a rear outer position with respect to a wall cupboard. In particular, this type of hanging bracket is generally coupled with a shoulder beneath the top, close to the lining of the wall cupboard, so that once constrained to the wall, the hanging bracket is well concealed. These groups are also provided with anti-disengagement for preventing an accidental detachment of the wall cupboard in the case of impact that can cause it to become detached from the wall.

These hanging brackets generally consist of a single plate element provided with various side protrusions (pins) which, in the assembly phase, are coupled with holes produced on a rear shoulder of the wall cupboard. These hanging brackets also comprise a movable hooking element connected to the relative plate for fixing the hanging bracket to the wall.

An anti-disengagement system is also provided, which intervenes, preventing any possible accidental disengagement of the wall cupboard from the wall on which is it mounted.

An example of a hanging bracket is described in international patent application WO2004/032681 A1.

An access to the various adjustments in height and in depth present in hanging brackets is provided by a pair of holes produced in the rear part of the furniture or lining.

In order to reduce perforated surfaces in the lining of the furniture, a single hole having a certain size is provided, from which access is given to both adjustments of the hanging bracket.

This solution is object of patent EP1008316B1, in this solution, however, there is also a certain structure complication. The reason for this is that some elements are produced from separate moulds and must therefore be joined to the base plate, thus requiring an increase in the production costs associated with the production of different pieces and an increase in the assembly costs for making them integral with each other before being mounted on the furniture.

DE 203 14 821 U1 and DE 202015 103519 U1 refer to a hanging-bracket group according to the preamble of claim 1.

SUMMARY OF THE INVENTION

The general objective of the present invention is to solve the drawbacks of the known art indicated above in an extremely simple, economical and particularly functional manner.

A further objective of the present invention is to provide a concealed hanging-bracket group with anti-disengagement which ensures an easy and stable assembly with as few components as possible and a secure attachment even in the case of unexpected stress.

Another objective of the present invention is to provide a concealed hanging-bracket group with anti-disengagement which minimizes separate moulded pieces to be joined to the base plate to form the hanging bracket.

In view of the above-mentioned objectives, according to the present invention, a concealed hanging-bracket group with anti-disengagement having easy access to adjustments has been conceived, having the features specified in the enclosed claims.

BRIEF DESCRIPTION OF THE SEVERAL VIEWS OF THE DRAWINGS

The structural and functional characteristics of the present invention and its advantages with respect to the known art will appear even more evident from the following description, referring to the enclosed drawings, which show a concealed and adjustable hanging bracket for mounting a wall cupboard to a wall, produced according to the present invention.

In the drawings.

DESCRIPTION OF SPECIFIC EMBODIMENTS OF THE INVENTION

Figure 2:
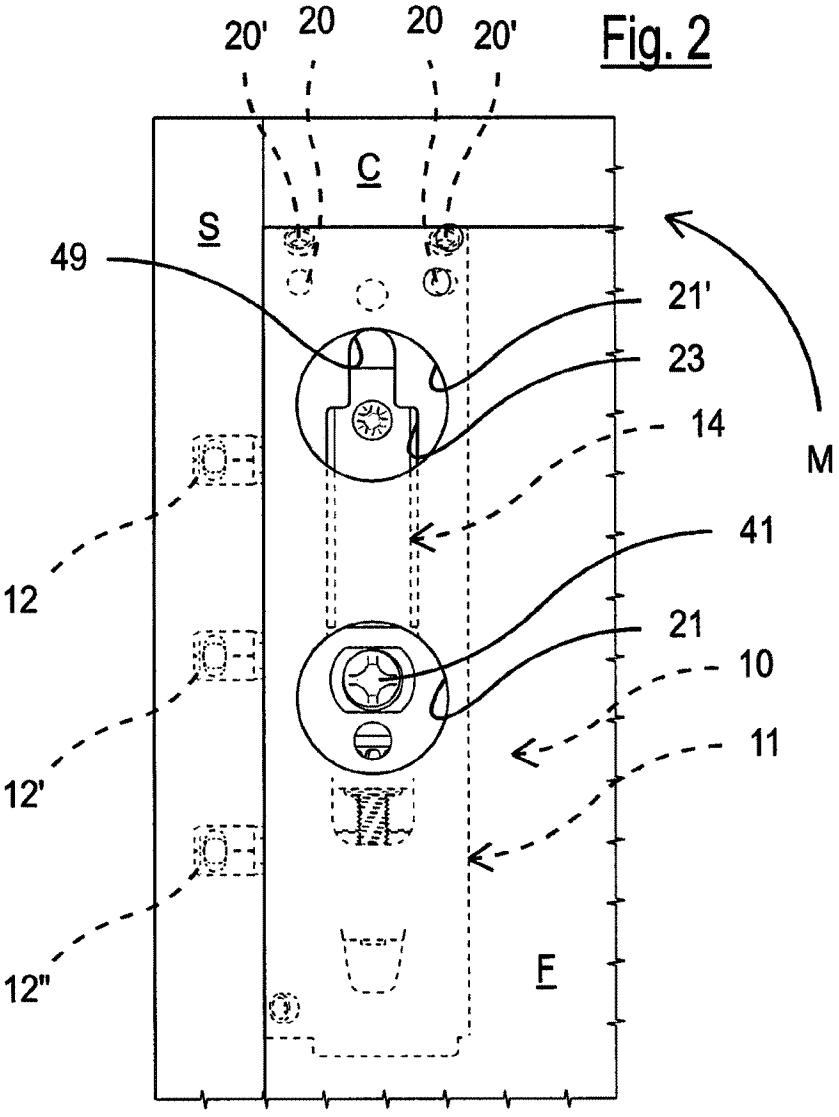
FIG. 2 is a view of the hanging bracket of FIG. 1 from inside the furniture.
Figure 1:
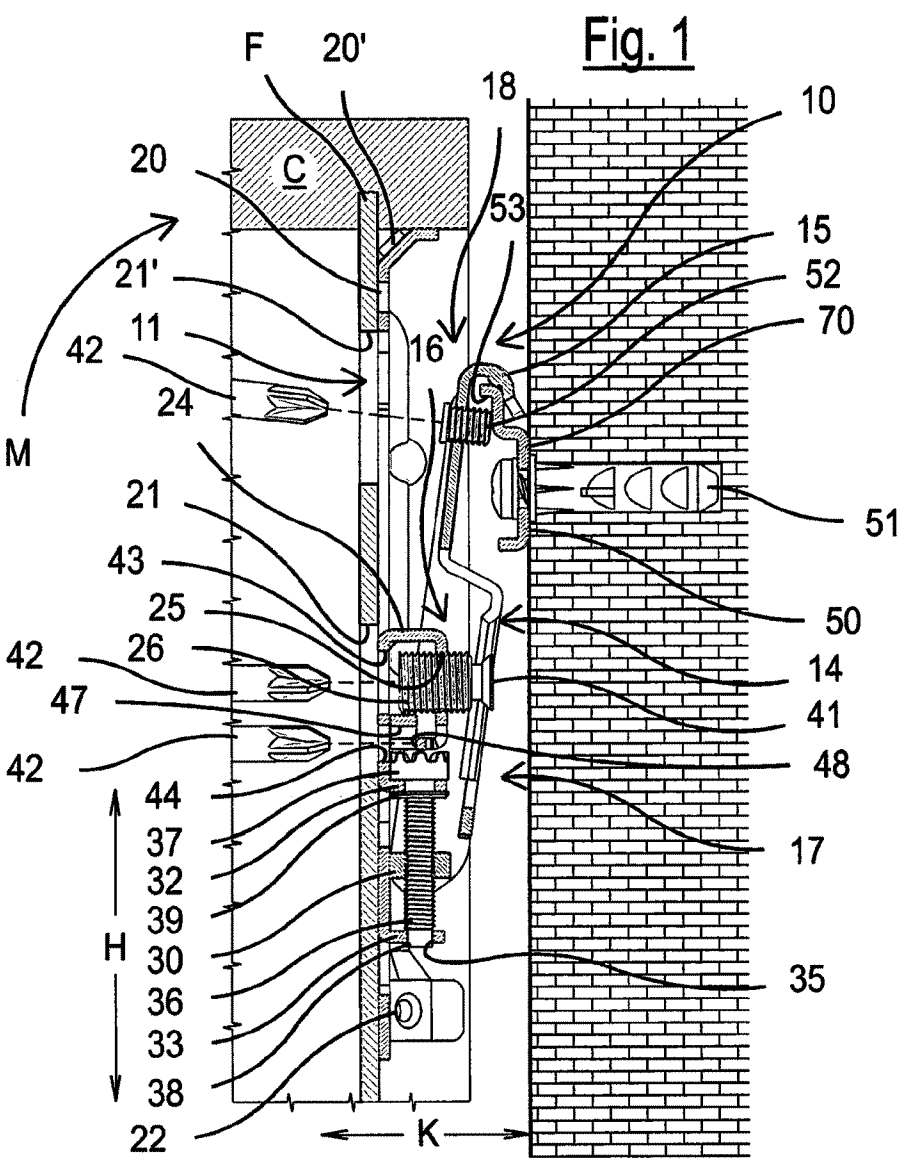
FIG. 1 shows a raised sectional view of an embodiment of a concealed hanging-bracket group with anti-disengagement for mounting a wall cupboard to a wall, produced according to the present invention.
Figure 5:
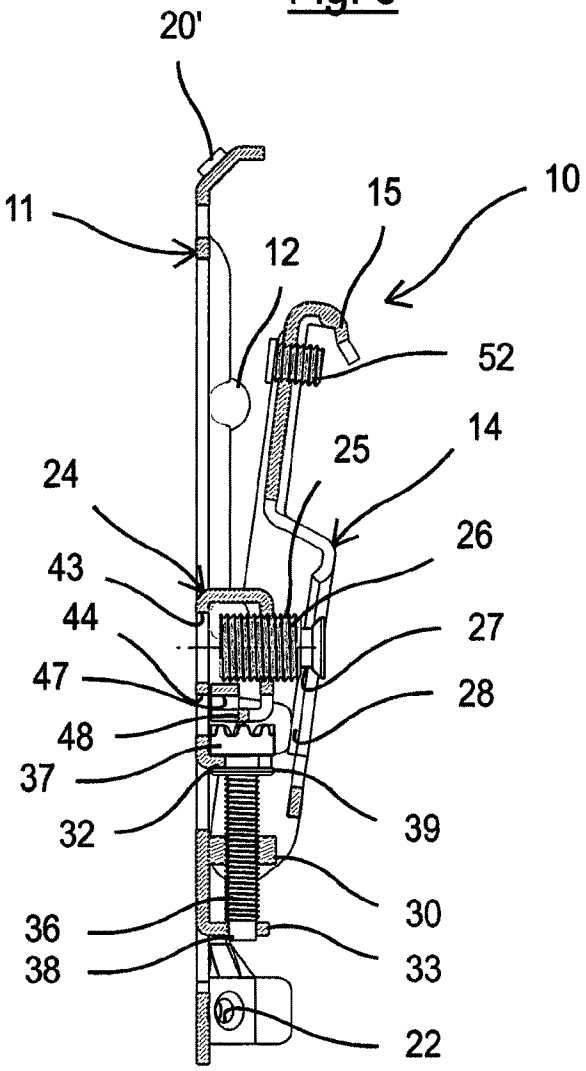
FIG. 5 is a sectional view of the hanging bracket of FIGS. 3 and 4 with the sheet folded.
Figure 4:
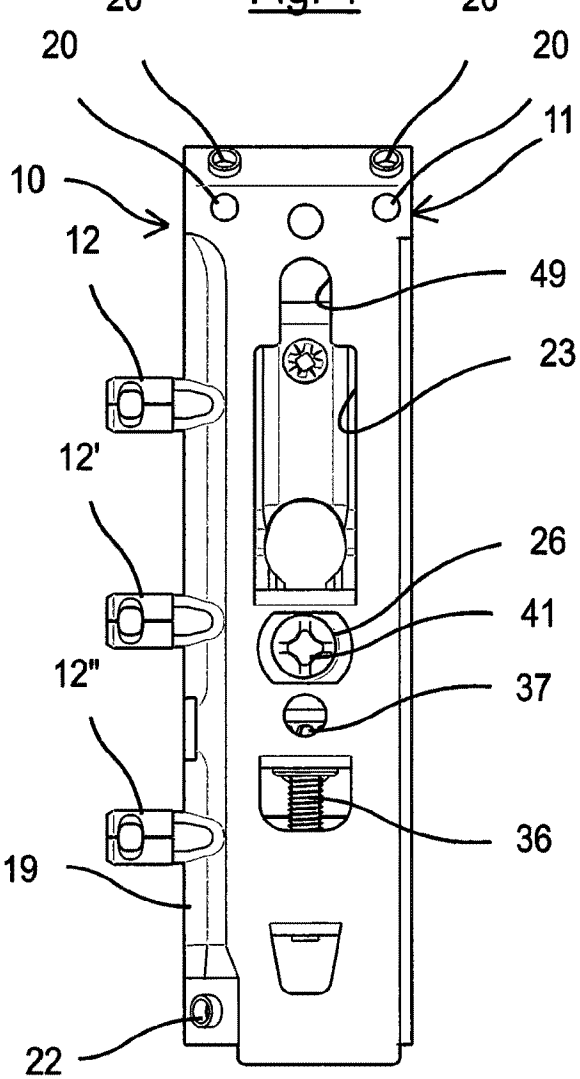
FIGS. 3 and 4 show raised front and rear views of the plate alone of the hanging bracket of FIG. 1 in a first embodiment.
Figure 3:
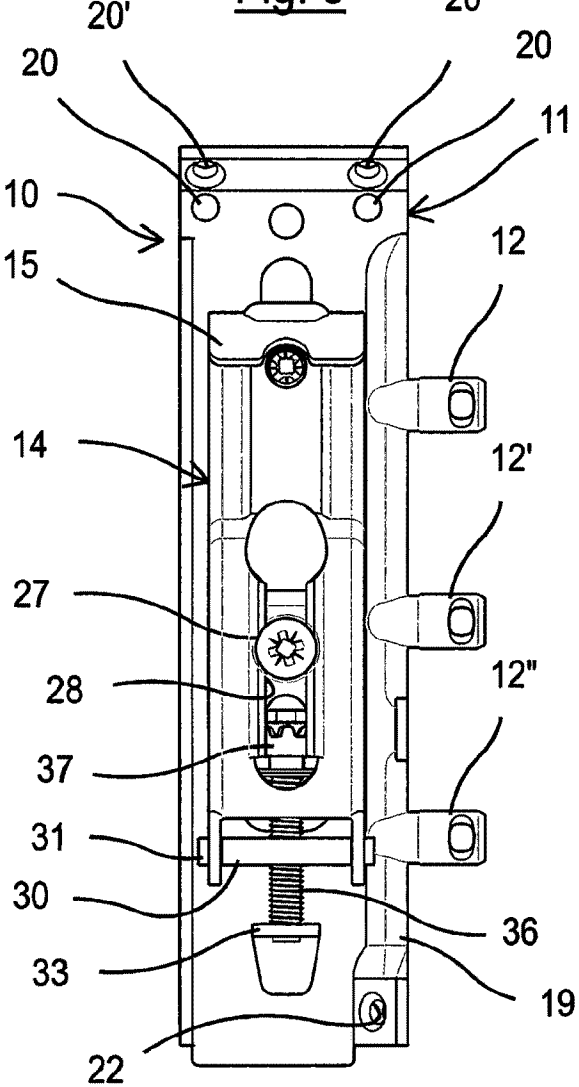
Figure 6:
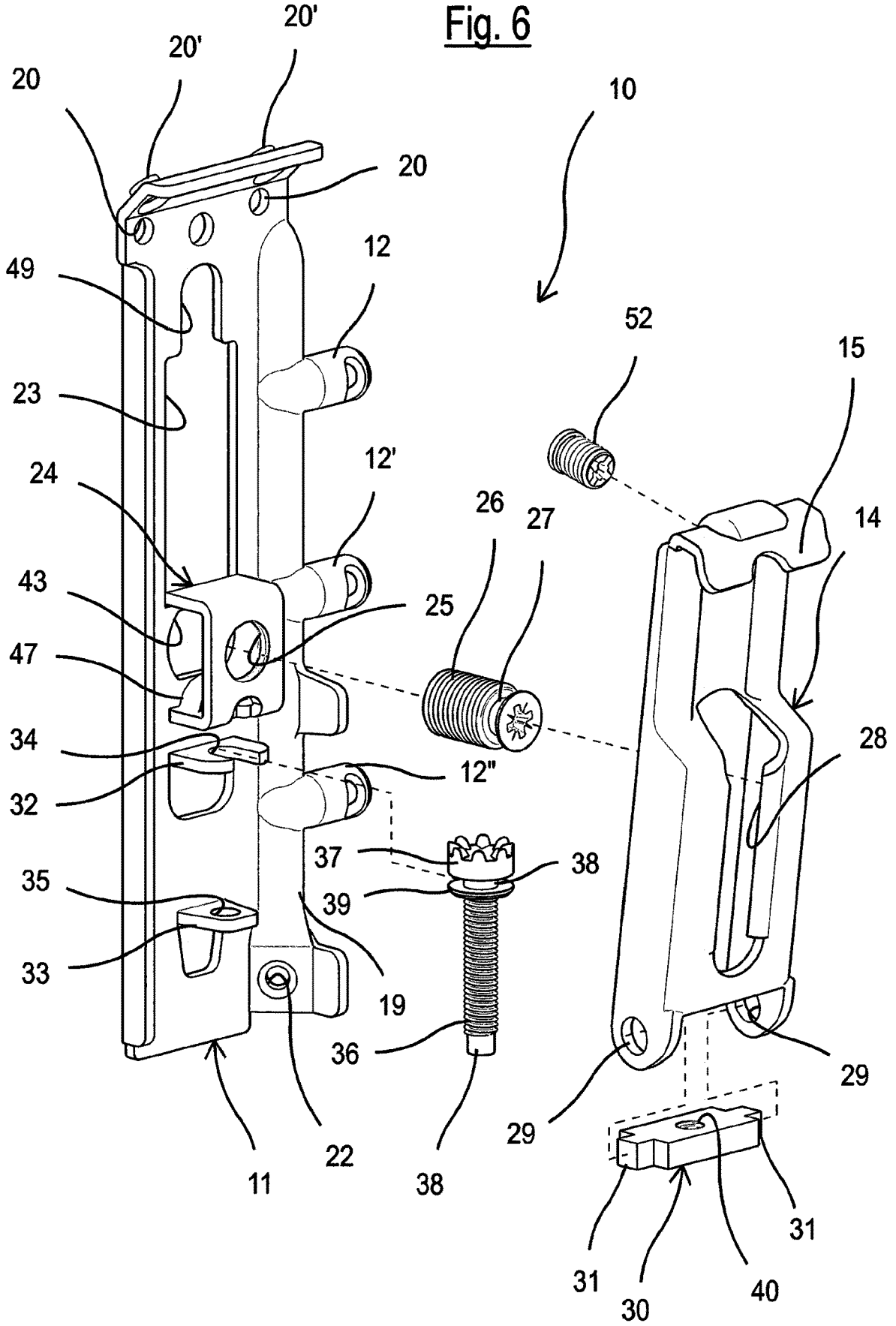
FIG. 6 is an exploded perspective view of the hanging bracket of FIGS. 3, 4 and 5.
Figures 7, 8, 9:
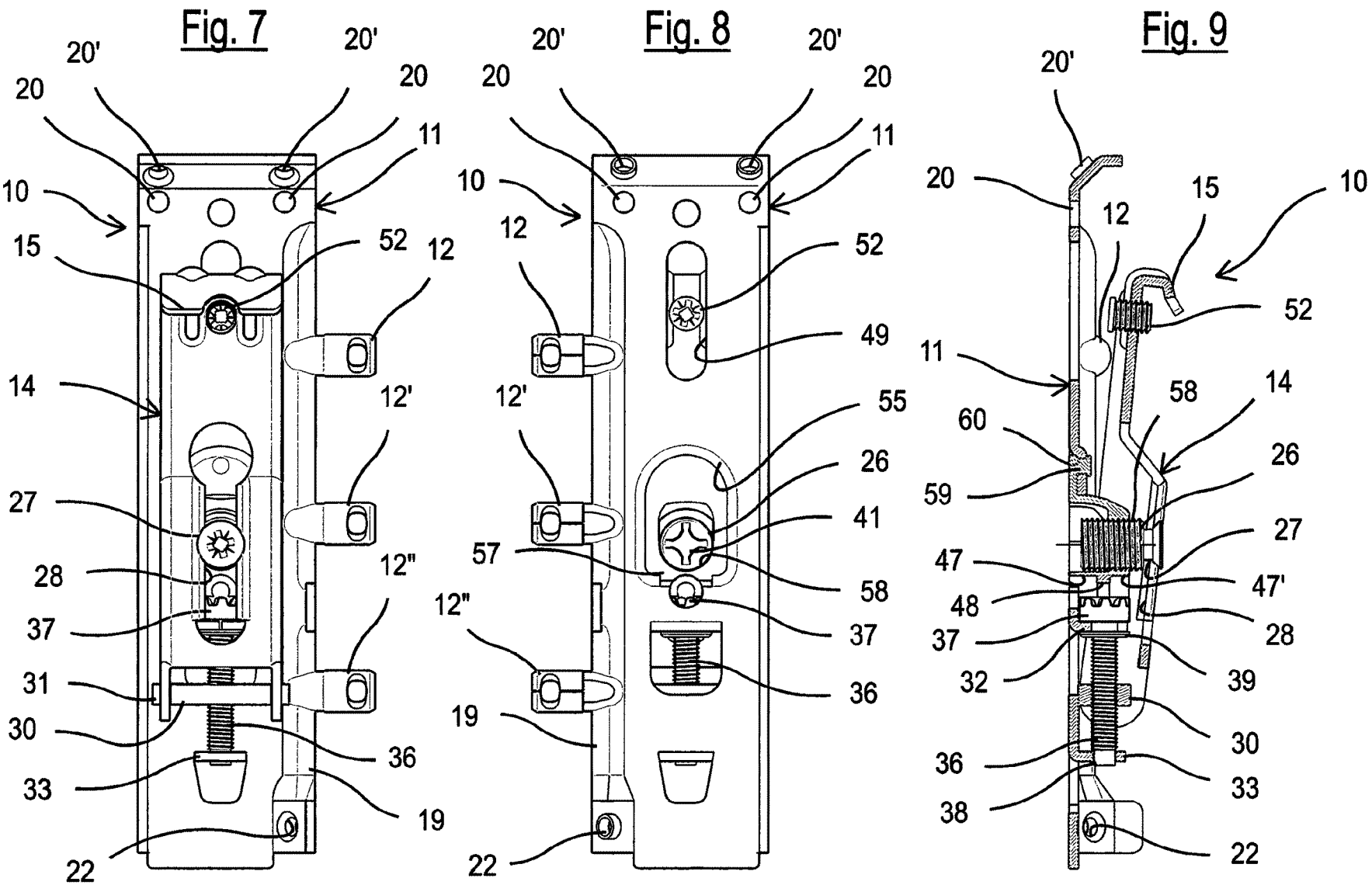
FIGS. 7 and 8 show raised front and rear views of the plate alone of the hanging bracket of FIG. 1 in a second embodiment.
FIG. 9 is a sectional view of the hanging bracket of FIGS. 7 and 8 with a mounting element added.
Figure 10:
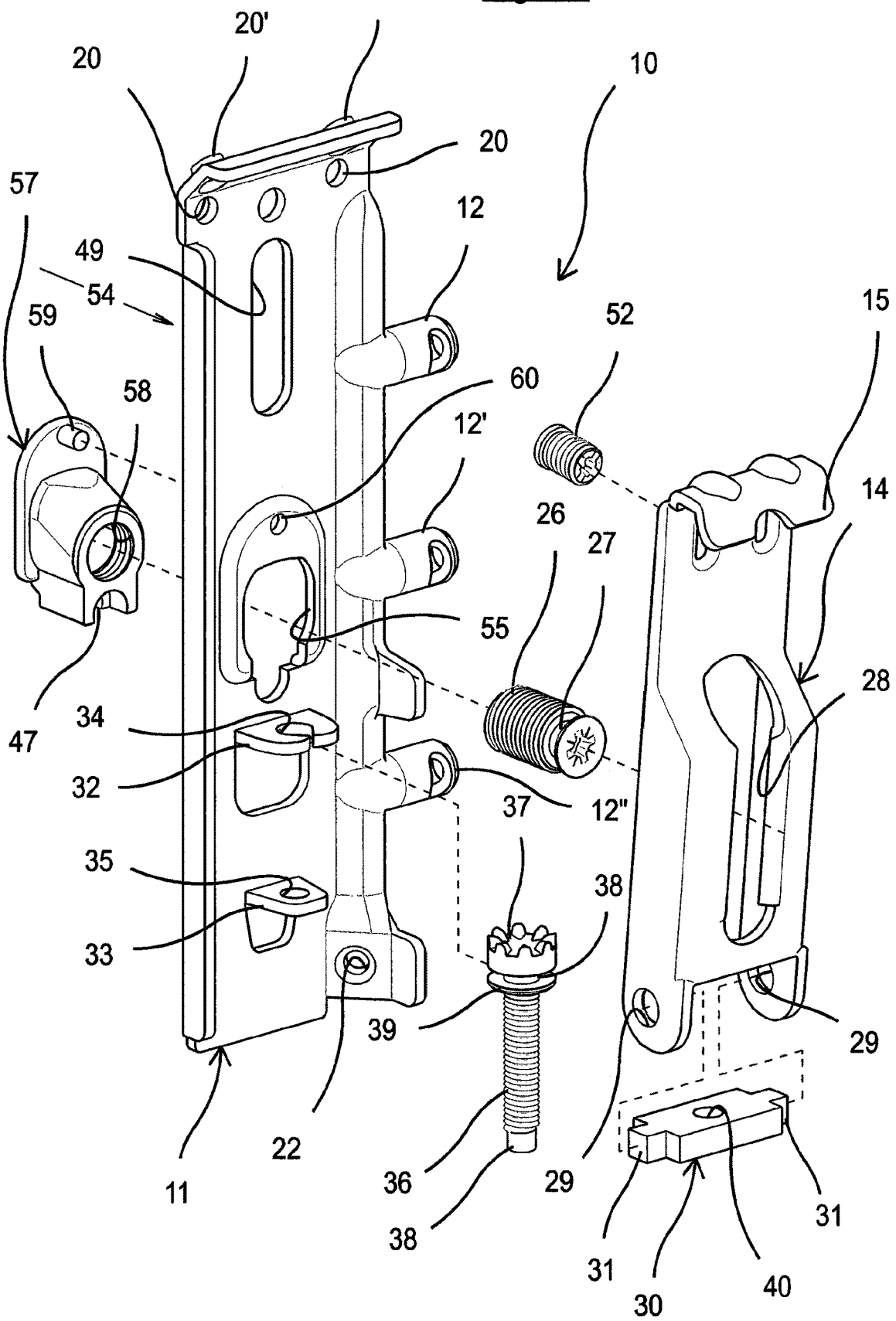
FIG. 10 is an exploded perspective view of the hanging bracket of FIGS. 7, 8 and 9.
Figures 11, 12, 13:
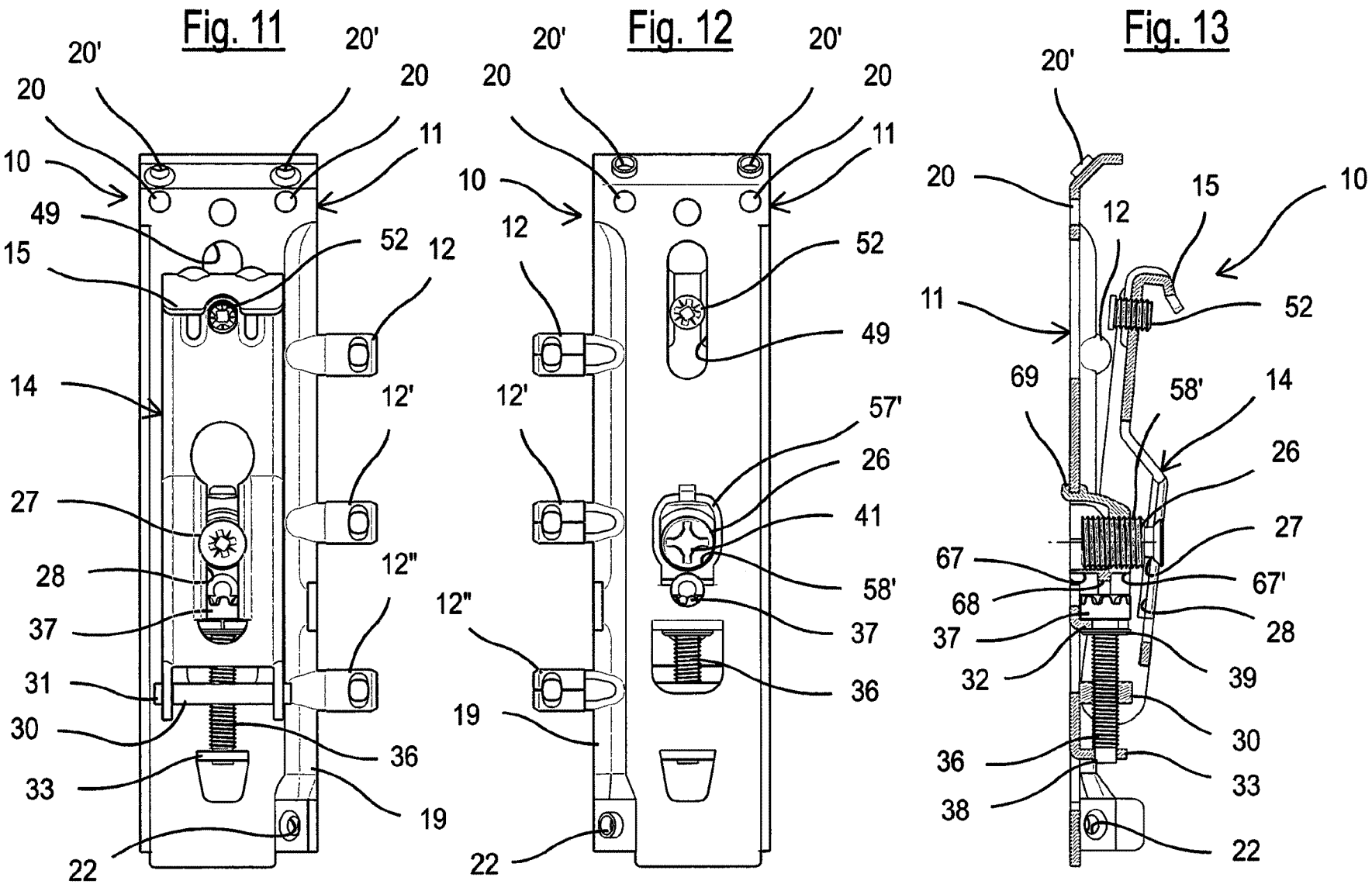
FIGS. 11 and 12 show raised front and rear views of the plate alone of the hanging bracket of FIG. 1 in a third embodiment.
FIG. 13 is a sectional view of the hanging bracket of FIGS. 11 and 12 with a mounting element added to be riveted.
Figure 14:
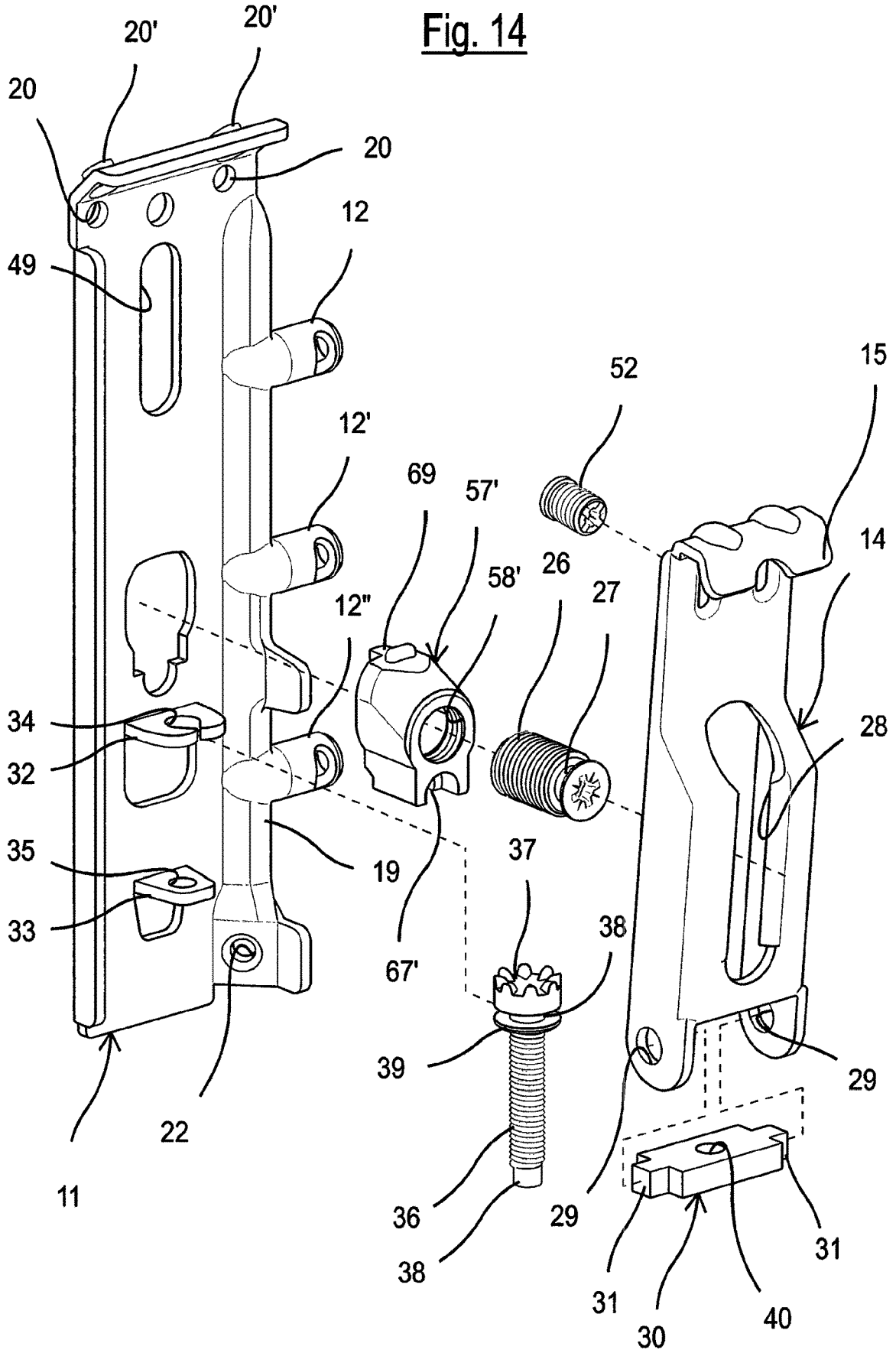
FIG. 14 is an exploded perspective view of the hanging bracket of FIGS. 11, 12 and 13.

With particular reference to FIGS. 1 and 2, these show an embodiment of a concealed hanging-bracket group with anti-disengagement having easy access to adjustments according to the present invention.

Said hanging-bracket group is of the adjustable type and suitable for being assembled at the rear, in a concealed position, on a wall-cupboard M.

The hanging-bracket group comprises a plate element 11 of a hanging bracket 10 provided with a plurality of fixing pins 12, 12', 12", which extend towards the outside on one side of the plate element 11 (and/or also on the other side), and a hooking element 14 coupled in the front with the plate element 11 to constrain the actual hanging bracket with a supporting element fixed to the wall, such as a supporting element 50. The plurality of fixing pins 12, 12', 12" can be coupled in holes formed on a shoulder S of the wall cupboard M whereas, for example, the supporting element 50 fixed to the wall on which the hanging bracket 10 is to be constrained, can be a common bar 70.

As in the known hanging brackets, also in the hanging bracket 10, object of the invention, the hooking element 14 can be adjusted in depth and in height with respect to the relative plate element 11 and is provided with an upper hook-shaped portion 15 (hook) to be coupled with the above-mentioned bar 70 fixed to the wall by means of dowels 51.

In order to proceed with this adjustment in depth and in height, movement means 16, 17 horizontally and vertically are provided, such as, for example, two known screw-nut screw mechanisms possibly equipped with angular return elements, and anti-disengagement means 18. Said movement and anti-disengagement means according to the invention are easily accessible for a user during both the assembly phases and when the hanging bracket 10 has been mounted from a pair of holes 21 and 21' formed in a rear lining F of the furniture M.

It should also be noted that the plate element 11 comprises, in its upper portion, at least one pair of holes 20, 20' for screw coupling the plate element itself 11 with the wall cupboard M (lining F and top C).

A tilted side wall 19 of the plate 11 is provided with at least one pass-through hole 22 for screw coupling with the shoulder S of the wall cupboard M, in which the fixing pins 12, 12', 12" are inserted.

According to the present invention, the plate 11 is produced from a single moulded sheet which provides a fixing arrangement for the movement means 16, 17 and adjustments horizontally and vertically and for the anti-disengagement means 18.

The plate 11, in fact, has a window 23, produced by means of a half-blanking step, from an end of which an appendix 24 extends, which is box-folded. On one of its sides parallel to the plate 11, said appendix 24 has a threaded hole 25 suitable for receiving an adjustment screw 26, or grub screw, provided with a recessed head 27. The recessed head 27 is inserted in a groove 28 provided on the box-shaped body of the hooking element 14.

It should be pointed out that, at an end opposite to the hook-shaped portion 15, the hooking element 14 has slots 29 suitable for receiving pin ends 31 of a platelet 30 which make it integral and articulated with respect to the plate 11.

The plate 11 also has two further appendices 32 and 33 obtained by half-blanking beneath the window 23. The two further appendices 32 and 33 are square-folded with respect to the surface of the plate 11.

The first further appendix 32 has a recess 34, rounded and open towards the outside. The second further appendix 33, on the other hand, has a pass-through hole 35.

A screw 36 is provided at one end with a toothed crown 37 and a narrow cylindrical section 38 and is positioned between the two further appendices 32 and 33. The screw 36 beneath the toothed crown 37 has a flange or collar 39 protruding outwardly, which is engaged in the recess 34, rounded and open towards the outside, of the first further appendix 32. Furthermore, the narrow cylindrical section 38 of the screw 36 is engaged in the pass-through hole 35 of the second appendix 33. The screw 36 is therefore free to rotate when actuated by the toothed crown 37.

It should also be noted that an intermediate section of the screw 36 is screwed into a threaded pass-through hole 40 of the platelet 30, which carries the hooking element 14 integrally and articulated.

Finally, it also should be pointed out that, at the end opposite to the recessed head 27, the adjustment screw 26 provides a shaped seat 41 for a tip of a screwdriver 42.

It should also be noted that the window 23 in the plate 11 extends above into a slot 49 from where the anti-disengagement means 18 can be actuated. Furthermore, the plate 11 beneath the window 23, has a pair of pass-through holes 43 and 44 that are aligned with the hole 21 produced in the lining F of the furniture M.

The rotation of the screw 26 using the tip of the screwdriver 42 inserted in the hole 21 and immediately afterwards in the hole 43 of the plate 11, effects an adjustment in depth of the hanging bracket according to the arrow K.

A tip of a screwdriver 42, when inserted in the hole 21 and immediately afterwards in the hole 44 of the plate, causes an engagement on the toothed crown 37 of the screw 36. A rotation of said screw 36 forces the platelet 30, which carries the hooking element 14 integrally and articulated, to move upwards effecting an adjustment in height of the wall cupboard according to the arrow H.

Finally, a tip of a screwdriver 42, when inserted in the hole 21' and immediately afterwards passing into the slot 49 of the window 23 in the plate 11, causes an engagement of a grub screw 52 in an undercut 53 of the bar 50 creating an anti-disengagement group.

It should be noted that, in the present invention, the movement means 16, 17 and adjustments of the hanging bracket horizontally and vertically, are basically contained inside the appendix 24 of the plate 11. This appendix 24, obtained by means of a half-blanking step of a window 23 in the plate 11, is square-folded on a front part of the plate (as can be seen in the figures) to form a containment casing of at least part of said adjustments or movement means 16, 17. Said casing is produced without any addition of material but by simply folding the appendix 24 in the form of a "C", to be closed on the plate 11.

The group according to the invention is characterized in that an element 24 is provided in the plate element 11, which has a threaded hole 25 for a grub screw 26 for adjustment in depth, a guide 47 for a screwdriver and a stop 48 for a tip of the same screwdriver 42 also being provided in said element 24.

The anti-disengagement grub screw 52 provides a simple arrangement which is a further feature of the hanging-bracket group of the present invention, making it complete and functional.

FIGS. 7 to 10 show various raised front views, in the front and rear, sectional and exploded perspective views, of a plate of the hanging bracket with a hooking element similar to that of FIG. 1 in a second embodiment.

In this embodiment, the same elements are indicated with the same reference numbers.

It should only be pointed out that, in FIGS. 7 to 10, as an alternative to the sheet folded on itself forming the appendix 24 of FIGS. 1 to 6, this example shows how the sheet of the plate 11 has a deep-drawn seat 55 which holds an element made of zama 57 having a threaded hole 58 for the grub screw 26 for adjustment in depth. The assembly direction is according to the arrow 54 and, in this case, a guide for the screwdriver 47 (on both sides also in 47') is provided together with a stop 48 for the tip of the same. It should also be noted that the element made of zama 57 is provided with a pin 59 to be inserted in a hole 60 of the plate 11 and to be riveted once inserted on the sheet of the plate 11 from the rear.

Also in this case, the group is characterized in that an element 57 is provided in the plate element 11, having a threaded hole 58 for a grub screw 26 for adjustment in depth, a guide for the screwdriver 47 also being provided in the element 27, together with a stop 48 for a tip of the same screwdriver 42.

Finally, FIGS. 11 to 14 show a third embodiment, having the same reference numbers for the same elements. In this example, the sheet of the plate 11 receives an element in zama 57' having a threaded hole 58' for the grub screw 26 for adjustment in depth, a guide 67 for a screwdriver 42 (on both sides also in 67') and a stop 68 for the tip of the screwdriver 42. Said element 57' is provided with a flap 69 to be riveted and is inserted on the sheet of the plate 11 from the front.

It should be pointed out that in an embodiment, the hanging-bracket group of the present invention is characterized in that the sheet of the body (half-blanked appendix 24), or of the plate 11, is folded on itself creating a seat for the threaded hole 25 which receives the grub screw 26 or screw for adjustment in depth. With this operation, a U-bolt folding 47 of a central end part is also defined, which is also half-blanked and which acts as a guide for the tip of the screwdriver 42. At the same time, an abutment or stop 48 is also created, effected by half-blanking without processing and additional pieces, as for the previous U-bolt folding 47.

To be able to effect the movement transmission between the tip of the screwdriver and toothed crown 37 of the screw 36, which effects the adjustment in height, it is essential that the tip of the screwdriver 42 be placed in a very precise position (FIG. 1) thanks to the presence of the guiding channel 47 and stop 48.

The tip of the screwdriver 42 is held in the guide by the hole 44 formed on the plate 11, the U-bolt 47 and the stop or abutment 48 of the tip 42.

The access of the tip of the screwdriver 42 for the adjustment in height, moreover, can also be provided from the opposite side of the hanging bracket 10, therefore from behind the lining F of the furniture M passing through the opening 44'.

From what is described above with reference to the figures, it is evident that a concealed hanging bracket according to the present invention is particularly useful and advantageous. The objectives mentioned in the preamble of the description have therefore been achieved.

The concealed and adjustable hanging bracket for the wall assembly of a wall cupboard according to the present invention, guarantees, in fact, an easy and stable assembly on any type of wall cupboard, whether it has an upper panel flush with the bottom panel or an upper panel flush with the side panels.

The forms and materials of the concealed and adjustable hanging bracket for the wall assembly of a wall cupboard according to the present invention can naturally differ from those shown for purely non-limiting illustrative purposes in the drawings.

The protection scope of the invention is therefore defined by the enclosed claims.

What is claimed is:

1. A concealed hanging-bracket group (10) with anti-disengagement having easy access to adjustments for a wall assembly of a wall cupboard (M) comprising:

a plate element (11), provided with a plurality of fixing pins (12,12',12") configured to be coupled in holes produced on a shoulder (S) of said wall cupboard (M) which extend from at least one side of said plate element (11);

a hooking element (14) configured to be coupled with a supporting element (50) fixed to a wall, adjustably coupled with said plate element (11) in depth (K) and in height (H) and provided with an upper hook-shaped portion (15);

movement means (16,17) for horizontally and vertically moving said hooking element (14) with respect to said plate element (11); and anti-disengagement means (18);

wherein said plate element (11) having an appendix (24) that comprises:

a threaded hole (25,58,58') for an adjustment grub screw (26) in depth, a guide (47) configured for guiding a screwdriver, and a stop (48) configured for stopping a tip of said screwdriver (42);

wherein said appendix (24) extends from an end of a window (23) formed in said plate element in a half blanking process, wherein said appendix (24) is box-folded on a front part of the plate element to form a containment casing of at least part of both the movement means (16,17) for horizontally and vertically moving said hooking element (14) with respect to said plate element (11).

2. The hanging-bracket group (10) according to claim 1, wherein said appendix (24) is folded in the form of a "C", to be closed on said plate element (11).

3. The hanging-bracket group (10) according to claim 1, wherein a surface of said plate element beneath (11) said window (23) provides a pair of holes (43, 44) for access to said movement means (16, 17).

4. The hanging-bracket group (10) according to claim 1, wherein a surface of said plate element (11) beneath said window (23) provides two further appendices (32,33) extended from a surface of the plate element (11).

5. The hanging-bracket group (10) according to claim 4, wherein a first (32) of said further appendices has a recess (34), rounded and outwardly open for receiving said adjustment screw (36), whereas a second (33) of said further appendices has a pass-through hole (35) for receiving an end of said adjustment screw (36), free to rotate.

6. The hanging-bracket group (10) according to claim 5, wherein said adjustment screw (36) has a toothed crown (37) provided with a flange or collar (39) protruding outwardly, which is engaged in a recess (34) of the first of said further appendices (32).

7. The hanging-bracket group (10) according to claim 4, wherein an intermediate section of said screw (36) is screwed into a threaded pass-through hole (40) of a platelet (30) positioned integrally and articulated with respect to said hooking element (14).

8. The hanging-bracket group (10) according to claim 4, wherein said adjustment screw (36) at an end opposite to a recessed head (27) provides a shaped seat (41) for the tip (42).

9. The hanging-bracket group (10) according to claim 1, wherein a free end of said appendix (24) is welded to said plate element (11).

10. The hanging-bracket group (10) according to claim 1, wherein a free end of said appendix (24) is riveted to said plate element (11).

11. The hanging-bracket group (10) according to claim 1, wherein a free end of said appendix (24) has a U-bolt folding (47) of a central end part which defines a guide for the tip (42).

12. The hanging-bracket group (10) according to claim 1, wherein a free end of said appendix (24) has a U-bolt folding (47) of a central end part which defines a guide and also a stop (48) for the tip (42).

13. The hanging-bracket group (10) according to claim 1, wherein said hooking element (14) it's a box-shaped body with a groove (28) sized and shaped for allowing a tip of the screwdriver (42) to pass towards said movement means (16,17).

14. A concealed hanging-bracket group (10) with anti-disengagement having easy access to adjustments for a wall assembly of a wall cupboard (M) comprising:

a plate element (11) having a plurality of fixing pins (12,12',12") configured to be coupled in holes produced on a shoulder (S) of said wall cupboard (M) which extend from at least one side of said plate element (11); a hooking element (14) configured to be coupled with a supporting element (50) fixed to a wall, adjustably coupled with said plate element (11) in depth (K) and in height (H) and provided with an upper hook-shaped portion (15), movement means (16,17) for horizontally and vertically moving said hooking element (14) with respect to said plate element (11); and anti-disengagement means (18);

wherein said plate element (11) having an appendix that comprises:

a threaded hole (25,58,58') for an adjustment grub screw (26) in depth, a guide (47) configured for guiding a screwdriver, and a stop (48) configured for stopping a tip of said screwdriver (42);

wherein said appendix is made of zama and having a threaded hole (58) for said adjustment grub screw in depth (26);

wherein, said hooking element (14) is movable with respect to said plate element (11) and said appendix extended from a window (23) in said plate element (11).

15. The hanging-bracket group (10) according to claim 14, wherein said appendix is provided with a pin (59) to be inserted in a hole (60) of the plate element (11) and to be repeated once inserted on the sheet of the plate element (11) from behind.

16. The hanging-bracket group (10) according to claim 14, wherein said appendix having a threaded hole (58') for an adjustment grub screw in depth (26), an additional guide (67,67') configured for guiding the screwdriver and an additional stop (68) configured for the tip of the screwdriver (42).

17. The hanging-bracket group (10) according to claim 16, wherein said appendix is provided with a flap (69) to be riveted and is inserted on the sheet of the plate element (11) from the front.

* * * * *